US005503219A

United States Patent [19]

Bortugno

[11] Patent Number: 5,503,219

[45] Date of Patent: Apr. 2, 1996

[54] GUTTER THAWING ARRANGEMENT

[76] Inventor: Raymond Bortugno, 1005 Tompkins Ave., S. Plainfield, N.J. 07080

[21] Appl. No.: 382,679

[22] Filed: Feb. 2, 1995

[51] Int. Cl.[6] ..... F24D 3/00

[52] U.S. Cl. ..... 165/47; 126/271.1

[58] Field of Search ..... 165/47; 126/271.1, 126/569

[56] References Cited

U.S. PATENT DOCUMENTS

| | | | |
|---|---|---|---|
| 3,431,972 | 3/1969 | Bernardi | 165/47 |
| 3,795,271 | 3/1974 | Adamic | 165/47 |
| 4,081,657 | 3/1978 | Stanford | 219/213 |
| 4,224,923 | 9/1980 | Wells | 126/417 |
| 4,291,673 | 9/1981 | Deutz | 126/569 |
| 4,401,880 | 8/1983 | Eizenhoefer | 219/213 |
| 4,606,402 | 8/1986 | Dupre | 165/47 |
| 4,763,450 | 8/1988 | Daniel | 126/569 X |
| 4,880,051 | 11/1989 | Ohashi | 165/47 X |
| 5,303,517 | 4/1994 | Scheider | 52/11 |

*Primary Examiner*—William E. Tapolcai

[57] ABSTRACT

Conduit structure is in pneumatic communication with a dwelling furnace of a forced hot-air variety to direct such forced hot air through a first conduit, through a control valve, and subsequently to a second conduit that is directed to a downspout that is in turn secured to a manifold positioned onto the gutter trough of the dwelling and to the bottom wall thereof.

4 Claims, 4 Drawing Sheets

GUTTER THAWING ARRANGEMENT

TECHNICAL FIELD

The field of invention relates to gutter thawing structure and to a gutter thawing arrangement wherein a manifold structure directs forced hot air within the associated gutter to effect thawing of accumulated ice therewithin.

BACKGROUND OF THE INVENTION

Prior art structure as exemplified in the prior art indicated by the U.S. Pat. Nos. 3,795,271; 4,081,657; 4,401,880; 4,606,402; and 5,303,517 are directed to devices for melting and thawing various snow and ice accumulations relative to a roof structure.

SUMMARY OF THE INVENTION

Conduit structure is in pneumatic communication with a dwelling furnace of a forced hot-air variety to direct such forced hot air through a first conduit, through a control valve, and subsequently to a second conduit that is directed to a downspout that is in turn secured to a manifold positioned onto the gutter trough of the dwelling and to the bottom wall thereof.

Objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DESCRIPTION OF THE PREFERRED EMBODIMENT

As required, detailed embodiments of the present invention are disclosed herein; however, it is to be understood that the disclosed embodiments are merely exemplary of the invention, which may be embodied in various forms. therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
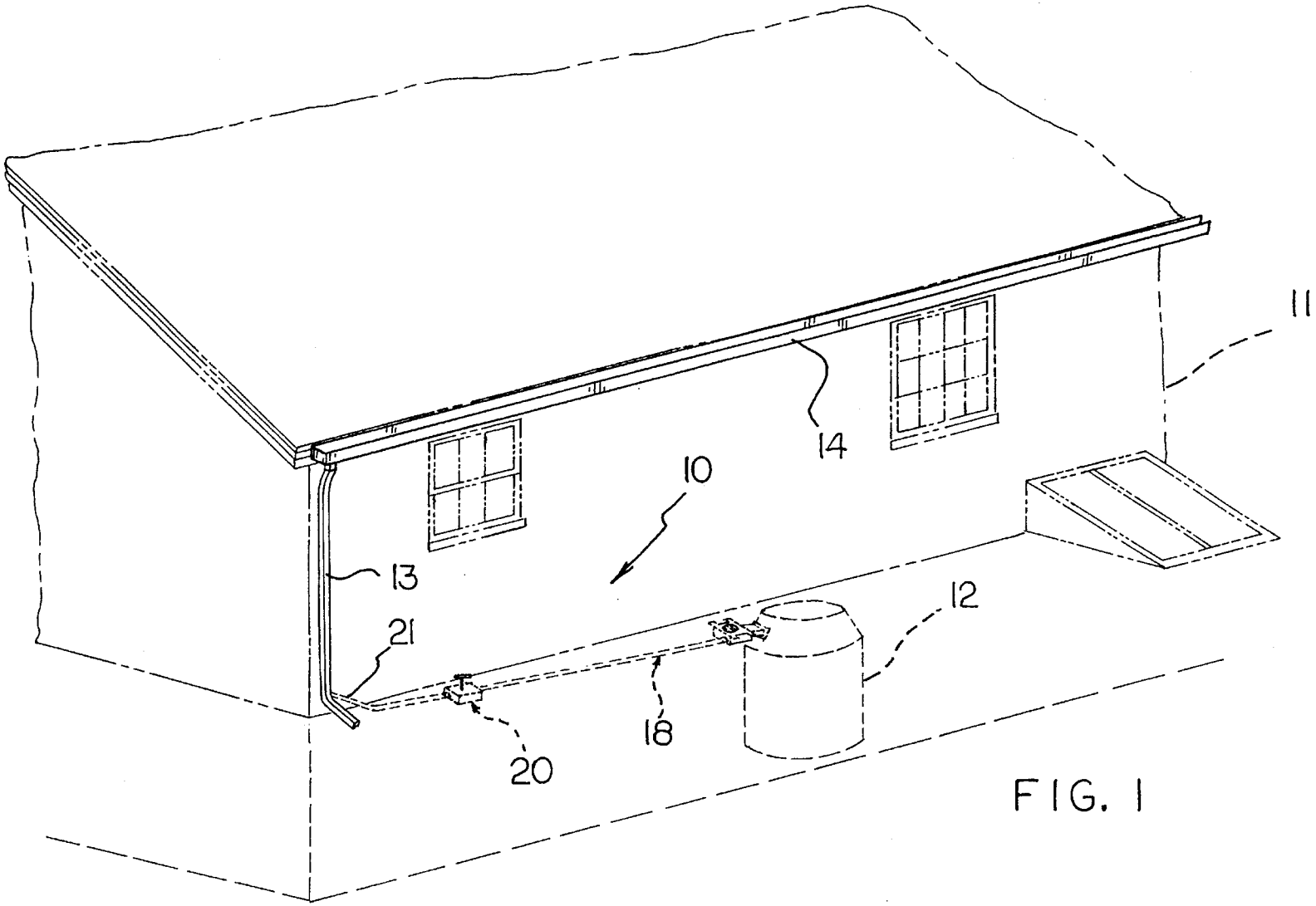
FIG. 1 is a perspective illustration of the invention in operative association with a dwelling.
Figures 2, 3:
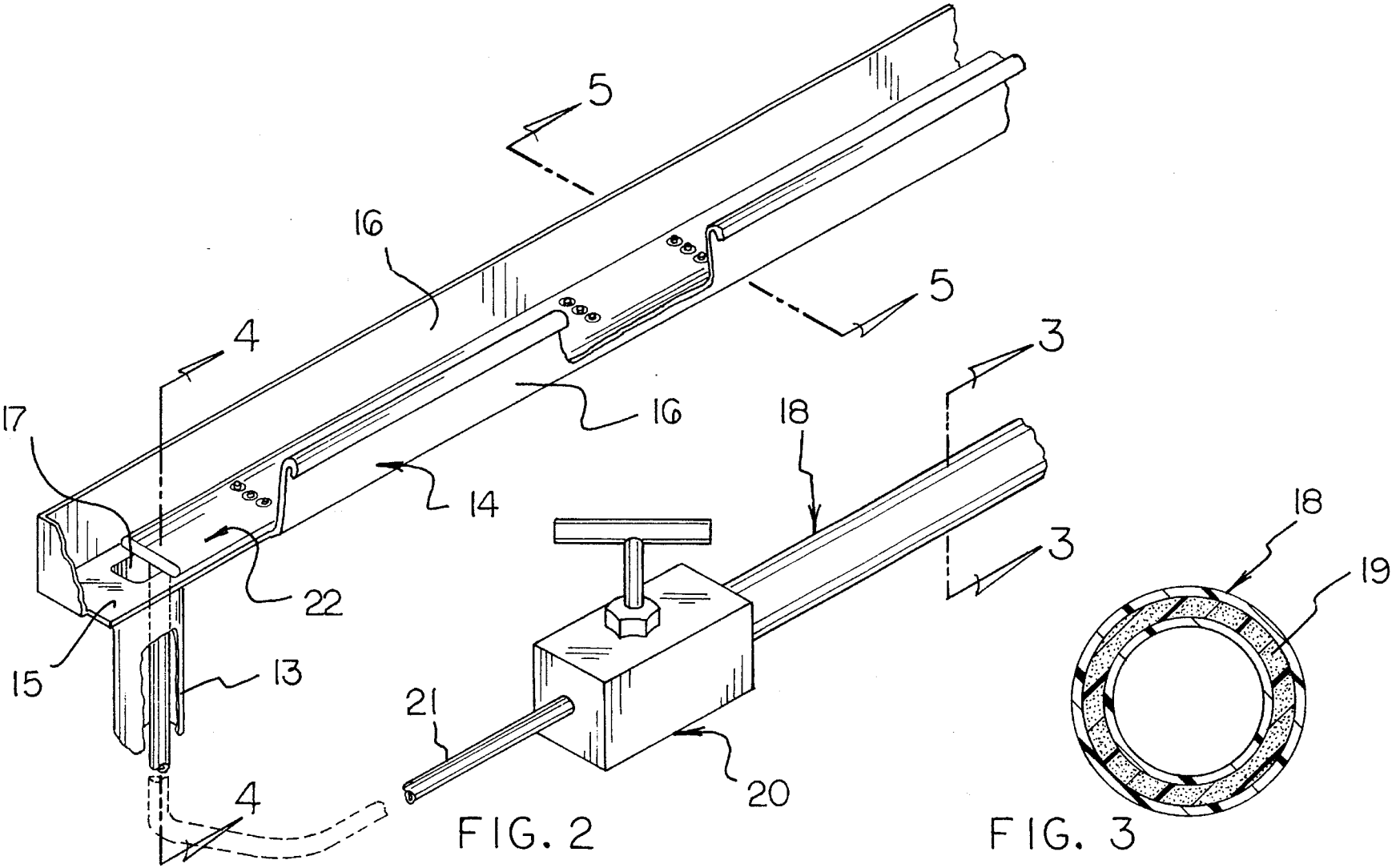
FIG. 2 is a perspective illustration, partially in section, to indicate the association of the thawing manifold and conduit structure relative to an existing gutter and downspout structure.
FIG. 3 is a cross-sectional illustration, taken along the lines 3—3 of FIG. 2 as indicated.
Figure 5:
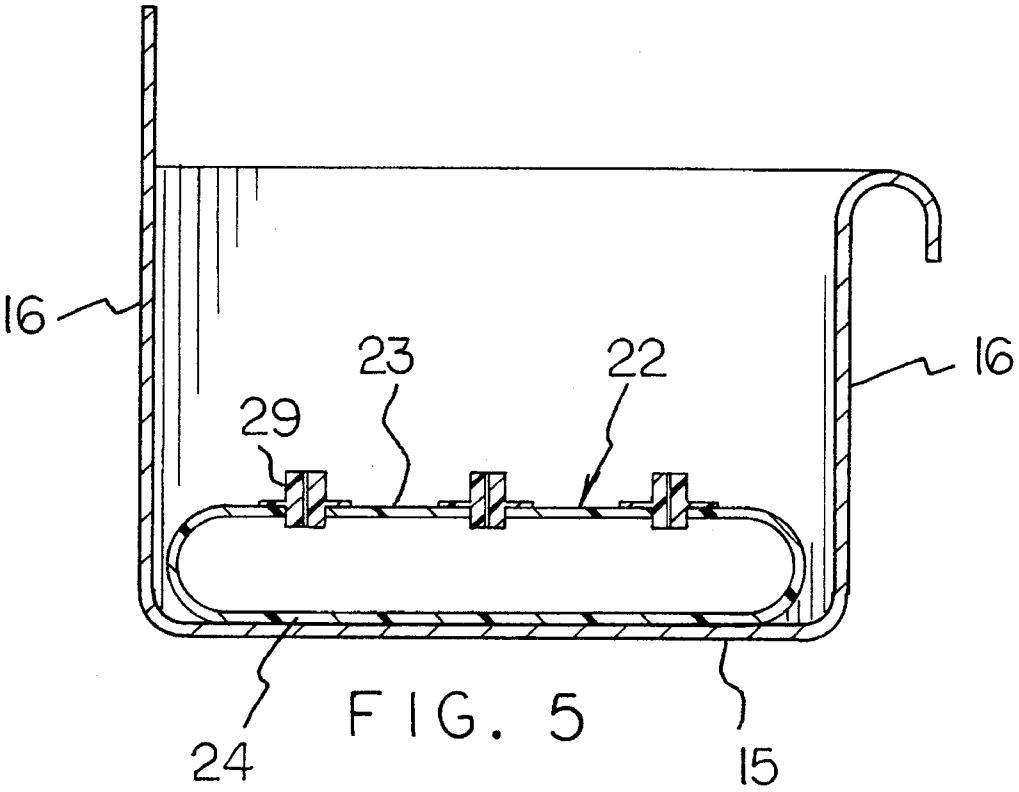
FIG. 5 is a cross-sectional illustration, taken along the lines 5—5 of FIG. 2 as indicated.

The gutter thawing arrangement 10 of the invention comprises association with a dwelling 11 having a forced hot-air type furnace 12. A gutter downspout conduit 13 is mounted to the dwelling 11 in a conventional manner, such that the downspout conduit 13 is in operative association with a gutter trough 14 directed adjacent to the roof of the dwelling 11, in a manner per se known in the prior art. The gutter trough 14 is formed with a trough bottom wall 15 and spaced side walls 16, such as indicated in FIG. 5 for example. The downspout conduit 13 employs a downspout opening 17 (see FIG. 2) directed through the trough bottom wall 15 to receive fluid from the trough 14 through the downspout conduit 13.

A first conduit 18 is in pneumatic communication with the furnace 12 and the first conduit 18, having a thermal insulative covering 19 (see FIG. 3) to minimize heat loss therethrough. The first conduit 18 is directed to a valve 20 of any desired type such as manual, electro-mechanical, or of any suitable valving to control pneumatic air-flow therethrough from the first conduit 18 to a second conduit 21. The second conduit 21 is directed through the downspout conduit 13, with the second conduit 21 typically formed of a polymeric, non-heat transmissive material. The second conduit 21 is directed to a manifold housing 22 of a heat transmissive material such as metallic structure, with the manifold housing 22 having a housing top wall 23 spaced from a housing bottom wall 24 that is directed in contiguous communication with the trough bottom wall 15. Spaced rows of exhaust ports 29 are directed through the manifold housing top wall 23 to permit air-flow of a heated type through the manifold cavity 26 that are in communication with the exhaust ports 29 to thereby assist in the thawing of ice, snow, and the like within the gutter trough 14.

Figure 4:
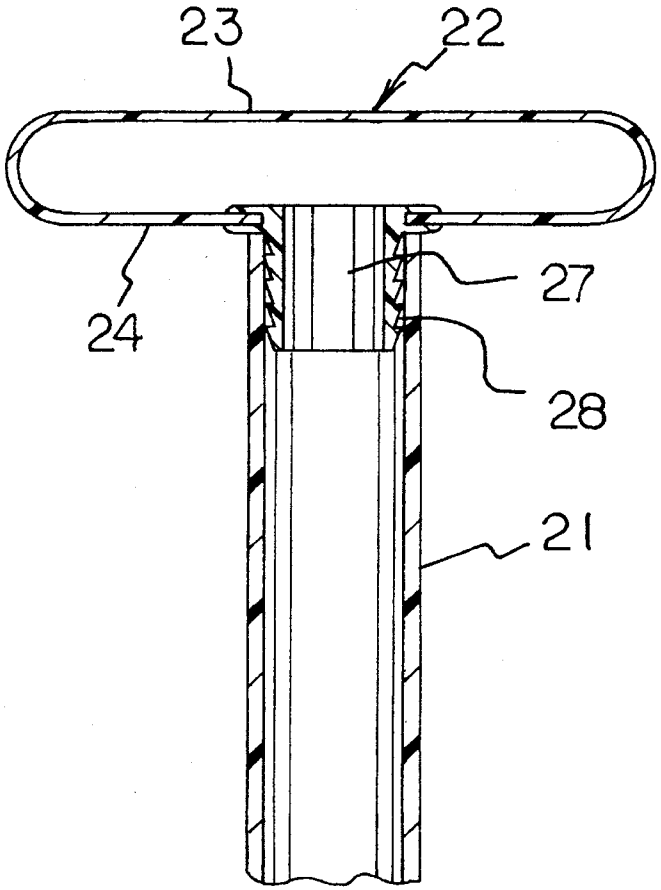
FIG. 4 is a cross-sectional illustration, taken along the lines 4—4 of FIG. 2 as indicated.

A connector 27 is secured to the manifold housing bottom wall 24 (see FIG. 4), with the connector 27 integral with the manifold housing bottom wall 24 and of a tubular construction having an outer engaging surface 28 typically of a barbed or toothed configuration to pneumatically secure in a fixed relationship the connector 27 to the uppermost distal end of the second conduit 21.

Figure 6:
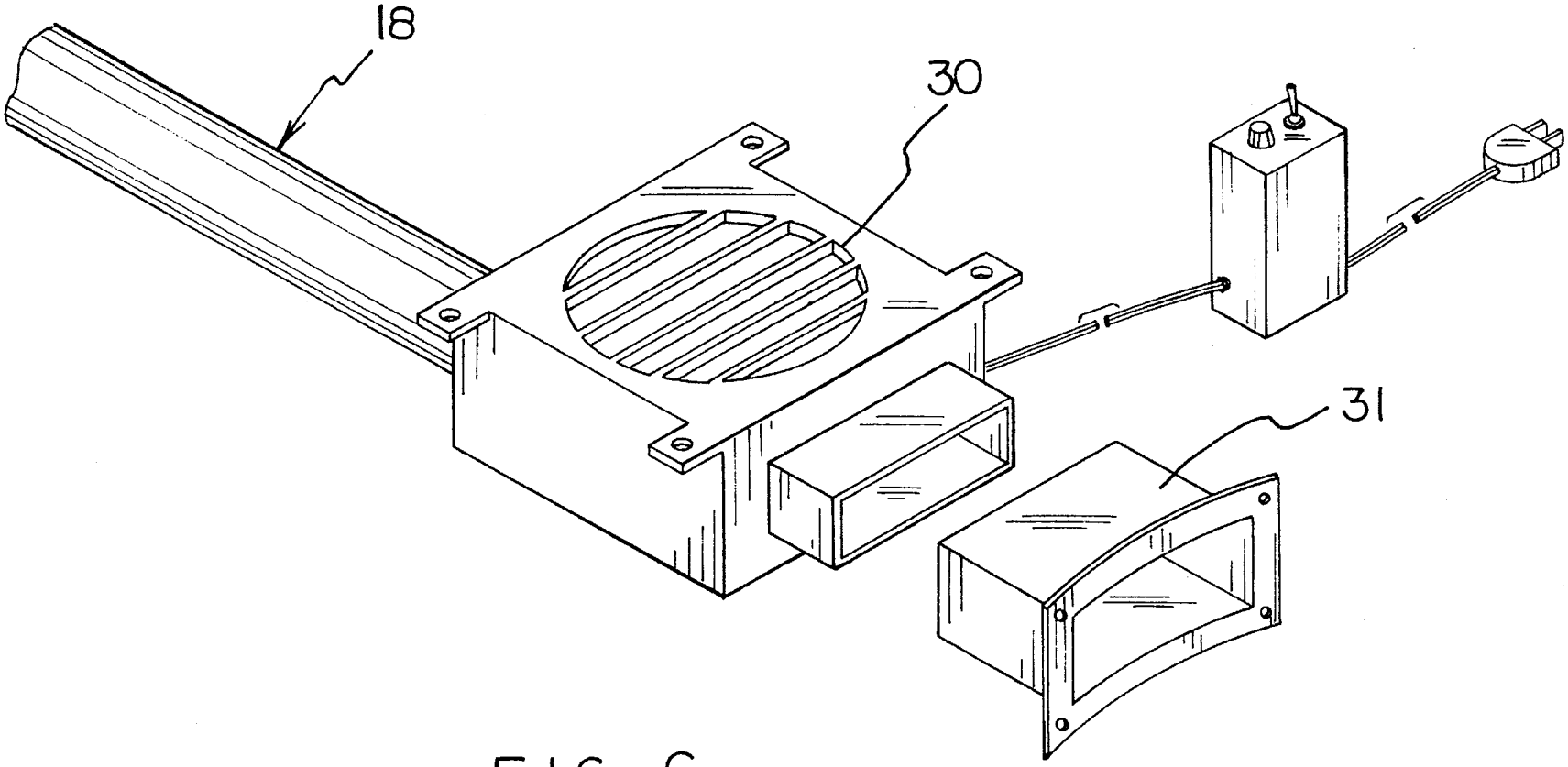
FIG. 6 is a perspective illustration of the invention as arranged for securement to an associated furnace.

The FIG. 6 indicates that an optional heat vent 30 may be secured to the first conduit 18, such that a first attaching conduit 31 may be optionally employed for securement to the optional heat vent 30, having a vented top wall such as illustrated, or the attaching conduit 31 being secured directly to the first conduit 18, such that air-flow therethrough is controlled by the valve 20.

It is to be understood that while certain forms of the present invention have been illustrated and described herein, it is not to be limited to the specific forms or arrangement of parts described and shown.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed and desired to be protected by Letters Patent of the United States is as follows:

1. A gutter thawing arrangement, comprised in combination with a dwelling, wherein the dwelling includes a forced hot-air means for directing forced hot air therefrom, and the dwelling further having a gutter downspout conduit directed along an exterior wall of the dwelling, and the dwelling having a roof, with a gutter trough directed along the dwelling adjacent to the roof, wherein the gutter trough has a bottom wall and spaced side walls, and the gutter trough having a downspout opening communicating the gutter trough with the downspout conduit, and a first conduit in pneumatic communication with the hot-air means, the first conduit of insulative covering, and a second conduit in pneumatic communication with the first conduit, with the second conduit directed through the downspout conduit and extends to the downspout opening, with a manifold housing positioned within the gutter trough, and the manifold housing in pneumatic communication with the second conduit, and the manifold housing formed of a heat transmissive material to direct heat therefrom within the gutter trough.

2. An arrangement as set forth in claim 1 wherein the manifold housing includes a housing bottom wall in contiguous communication with the trough bottom wall, and a housing top wall spaced from the housing bottom wall, the housing top wall having a plurality of exhaust ports directed therefrom to direct heated air through the exhaust ports within the gutter troughs.

3. An arrangement as set forth in claim 2 wherein the first conduit includes a thermal insulative covering, and the second conduit is formed of a polymeric non-heat transmissive material.

4. An arrangement as set forth in claim 3 with the manifold housing having a manifold cavity therewithin, and a connector secured to the manifold housing in pneumatic communication with the manifold cavity, the connector including an outer surface projecting exteriorly of the manifold cavity and the outer surface received within a free distal end of the downspout conduit within the downspout opening to secure the manifold to the second conduit in a retrofit relationship relative to the downspout conduit and the gutter trough.

* * * * *